US006519848B2

(12) United States Patent
Komazaki et al.

(10) Patent No.: US 6,519,848 B2
(45) Date of Patent: Feb. 18, 2003

(54) METHOD FOR PRODUCING CYLINDER BLOCK

(75) Inventors: Toru Komazaki, Tokyo (JP); Izumi Murashima, Fuchu (JP); Naomi Nishi, Tokyo (JP); Ryusuke Izawa, Shizuoka-ken (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 09/875,853

(22) Filed: Jun. 8, 2001

(65) Prior Publication Data

US 2002/0078564 A1 Jun. 27, 2002

(30) Foreign Application Priority Data

Jun. 9, 2000 (JP) ..... 2000-174548

(51) Int. Cl.[7] ..... B23P 15/00

(52) U.S. Cl. ..... 29/888.61; 29/888.6; 29/557; 29/527.5

(58) Field of Search ..... 29/888.061, 888.06, 29/557, 558, 527.5, 527.6, 527.7; 164/100

(56) References Cited

U.S. PATENT DOCUMENTS 4,005,991 A * 2/1977 Uebayasi et al. ..... 427/290
6,286,210 B1 * 9/2001 Ruckert et al. ..... 123/669
2001/0037789 A1 * 11/2001 Walker ..... 123/195 R

FOREIGN PATENT DOCUMENTS

JP 10-94867 4/1998 ..... B22D/19/00

* cited by examiner

*Primary Examiner*—I Cuda-Rosenbaum
(74) *Attorney, Agent, or Firm*—Sughrue Mion, PLLC

(57) ABSTRACT

A method for producing a cylinder block capable of providing sufficient bonding between the cylinder liner and a block body. The cylinder block producing method includes an inner peripheral surface roughening process, outer peripheral surface roughening process, adiabatic particle adhesion process, and melt bonding process. In the inner peripheral surface roughening process, shot blasting is performed to the inner surface of the cylinder liner. In the outer peripheral surface roughening process, semi-spherical dimples are formed on the outer surface of the cylinder liner by sinking the shot balls by their semi-spherical amount into the liner by means of shot blasting. Zn balls and stainless beads each having diameter of 0.4 mm, or Zn balls having diameter of 0.8 mm are used as the shot balls. In the adiabatic particle adhesion process, BN particles are adhered to the inner surface of the cylinder liner. In the melt-bonding process, a molten metal is filled around the cylinder liner to form a cylinder block while the liner is held by a metal mold and while a part of the metal mold is abutted to the inner surface of the cylinder liner.

3 Claims, 7 Drawing Sheets

METHOD FOR PRODUCING CYLINDER BLOCK

BACKGROUND OF THE INVENTION

The present invention relates to a method for producing a cylinder block, and more particularly, to such a method including the steps of holding an inner peripheral surface of a cylinder liner by a metal mold, filling a molten metal around the cylinder liner, the molten metal being a material of the cylinder block body, and melt-bonding the molten metal to the cylinder liner.

An insert is conventionally performed for producing a cylinder block in which a molten metal which is a material of the cylinder block body is filled around the cylinder liner. Laid-open Japanese Patent Application publication No. Hei-10-94867 discloses a method for producing a cylinder block. The method includes the steps of performing a shot blast to the outer peripheral surface of the cylinder liner, and then setting the cylinder liner at a predetermined position of a metal mold for casting a cylinder block body. According to this method, particles used in the shot blast are of fragment forms, tetrahedron forms, pyramid forms or lancet forms those having acute angles, and these particles are blown onto the outer peripheral surface of the cylinder liner. Average particle size is about 70 $\mu$m. Connection between the cylinder liner and the block body can be ensured by roughening the outer peripheral surface of the cylinder liner upon impingement of the particles thereonto.

However, in the conventional method for producing the cylinder block, optimum integral condition for the connection between the cylinder liner and the cylinder block body is unclear such as a condition of shot blast capable of providing efficient heat transmission from the cylinder block body to the cylinder liner when connecting the block body and the cylinder liner together. Further, average particle size in the conventional shot blast is 70 $\mu$m. However, no theoretical support is provided as to this particle size. Furthermore, in the conventional shot blasting method, spherical particles are not used but fragmental particles having acute angle are used. Therefore, size of the spherical particles, if used in the shot blasting method, is not clear.

SUMMARY OF THE INVENTION

It is therefore, an object of the present invention to provide a method for producing a cylinder block, the method being capable of providing improved bonding between the cylinder block body and the cylinder liner.

This and other objects of the present invention will be attained by providing a method for producing a cylinder block including the steps of outer surface roughening process, melt bonding process and inner surface roughening process. In the outer surface roughening process, an outer peripheral surface of a cylinder liner formed of aluminum alloy is roughened by shot blasting. In the melt bonding process, a molten metal is melt bonded to the outer peripheral surface of the cylinder liner by filling the molten metal around the outer peripheral surface of the cylinder liner, while the cylinder liner is held to a metal mold by abutting the metal mold to an inner peripheral surface of the cylinder liner. In the inner surface roughening process, the inner peripheral surface of the cylinder liner is roughened by shot blasting prior to the melt-bonding step.

In this method, contacting degree between the cylinder liner and the metal mold can be lowered by the inner peripheral surface roughening process by means of shot blasting to the inner peripheral surface. Thus, heat insulation between the cylinder liner and the metal mold can be improved. Accordingly, temperature decrease of the cylinder liner can be restrained during melt bonding process, thereby improving melt bonding between the cylinder liner and the block body.

Preferably, the shot-blasting for roughening the outer peripheral surface includes the step of forming semi-spherical recesses at the outer peripheral surface by striking at least one shot ball onto the outer peripheral surface. Because semi-spherical dimples are formed at the outer peripheral surface of the cylinder liner by shot blasting the outer peripheral surface in the outer peripheral surface roughening process, heat transmission coefficient from the molten metal to the cylinder liner can be enhanced. Therefore, melt bonding degree between the molten metal as the block body and the cylinder liner can be enhanced.

Preferably, the method further includes the step of adhering adiabatic powders onto the inner peripheral surface of the cylinder liner after roughening the inner peripheral surface and prior to the melt bonding step. Because the adiabatic particle is adhered to the inner peripheral surface of the cylinder liner in the adhesion process, heat insulation between the metal mold and the cylinder liner can be enhanced thereby restraining temperature decrease of the cylinder liner during the melt bonding process. Thus, melt bonding between the cylinder liner and the block body can be improved.

DETAILED DESCRIPTION OF THE PREFERRED EMBODIMENTS

A method for producing a cylinder block according to one embodiment of the present invention will be described. First, a process of R & D activities will be described. A cylinder liner is formed of hypereutectoid Si alloy containing from 14 wt % to 25 wt % of Si in compositions of Al—Si—Cu. A molten metal is casted around this cylinder liner to provide a cylinder block.

In order to improve bonding strength between the cylinder liner and the molten metal, sufficiently high temperature is required in the cylinder liner during the insert. A computer simulation was performed in order to estimate temperature change in the cylinder liner during the insert dependent on various preheating temperature to the cylinder liner. Analysis condition in this simulation was as follows:

Analysis condition

Temperature of metal mold: 150° C.

Figure 1:
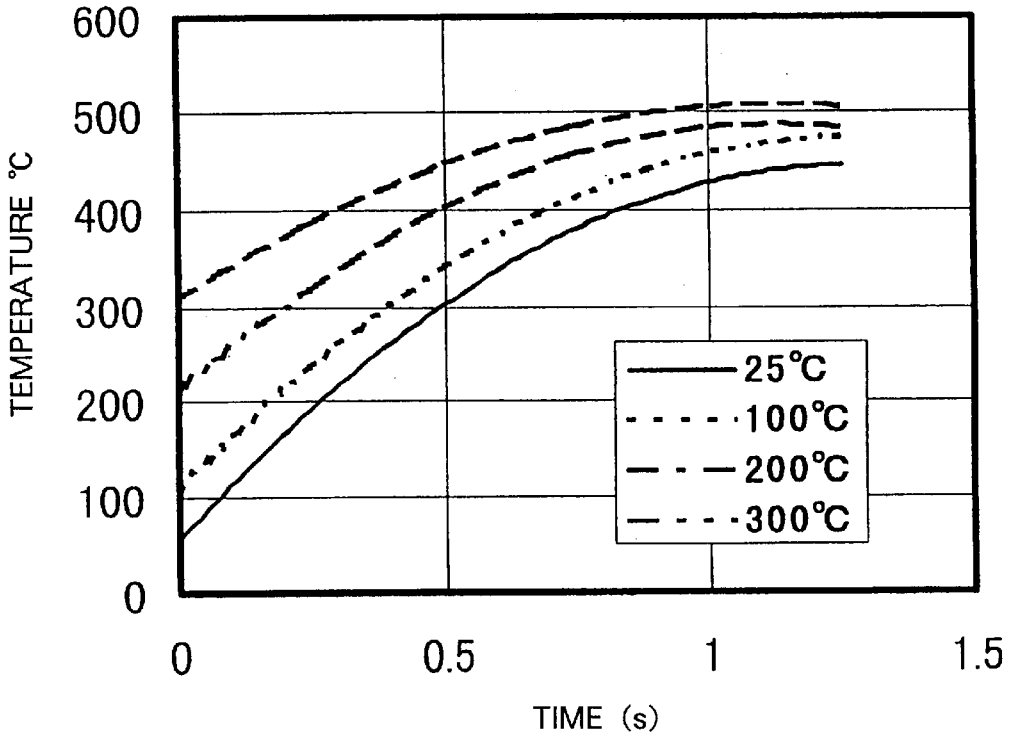
FIG. 1 is a graph showing conceivable temperature change of a cylinder liner during melt bonding process in a method for producing a cylinder block according to one embodiment of the present invention.

Casting temperature: 700° C. Heat transmission coefficient between liner/block body: 0.2 cal/cm$^2$/° C./S Insert was simulated assuming that the liners having preheating temperatures of 25° C., 100° C., 200° C. and 300° C., were used respectively. FIG. 1 shows a graphical representation showing change in temperature of each liner with elapse of time. As shown in FIG. 1, even if the preheating temperature of the liner was 300° C. prior to the insert, the temperature of the liner was increased to about 520° C. at most as a result of the insert. The temperature of about 520° C. is solidus temperature of the above-described Al—Si—Cu alloy constituting the cylinder liner. Accordingly, melt-bonding between the cylinder liner and the cylinder block body cannot occur because the temperature of the liner at the time of insert is not higher than the solidus temperature.

Figure 2:
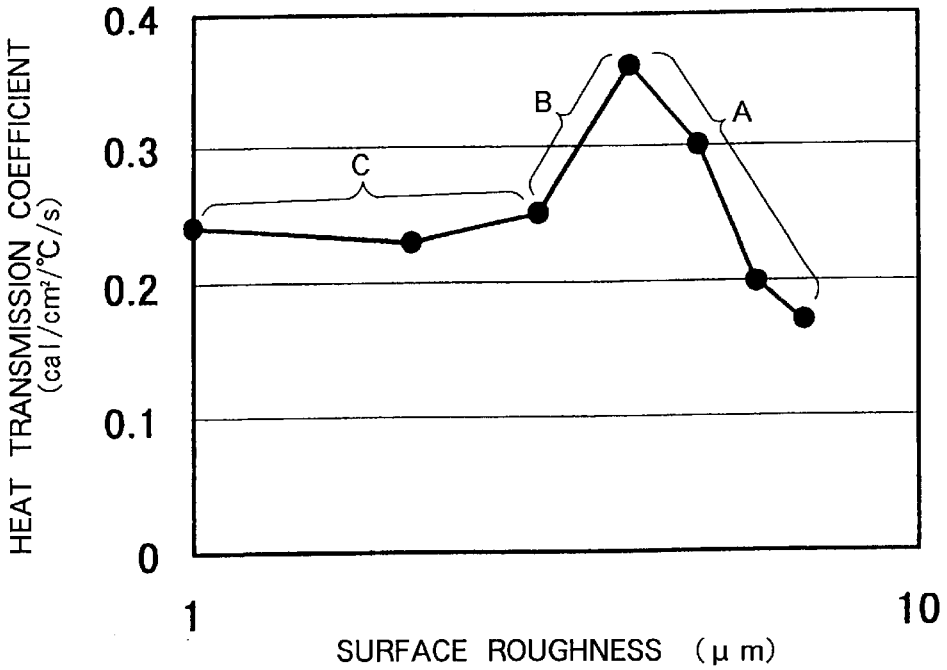
FIG. 2 is a graph showing the relationship between conceivable heat transmission coefficient and surface roughness of the cylinder liner used in the method for producing the cylinder block according to one embodiment of the present invention.

Next, experiments were conducted in order to investigate the relationship between the heat transmission coefficient and surface roughness of the cylinder liner whose surface is formed with minute recesses by shot blast. In the experiments, heat transmission coefficient was measured with respect to each test piece each having surface roughness of from 1 $\mu$m to 10 $\mu$m. As shown in a right side region A in FIG. 2, the heat transmission coefficient becomes low in accordance with the increase in surface roughness, and the heat transmission coefficient becomes high in accordance with the decrease in the surface roughness. This appears to be due to the increase in surface area of the cylinder liner in accordance with the decrease in surface roughness, thereby increasing an apparent heat transmission coefficient. In a central region B in FIG. 2, the heat transmission coefficient is lowered despite of the further decrease in the surface roughness after the heat transmission coefficient reaches a predetermined level. This appears to be due to the increase in a non-contacting area of the liner with the molten metal because the molten metal cannot reach each bottom of each minute recess due to the surface tension thereof in accordance with the further decrease of the surface roughness. The heat transmission coefficient is further lowered to a predetermined level in accordance with further decrease in the surface roughness. However, the predetermined level is the minimum value as shown in a region C in FIG. 2. This appears to be due to excessive decrease in surface roughness, and the non-contacting area of the liner with the molten metal is not so increased despite of the further decrease in the surface roughness, so that the heat transmission coefficient is not greatly changed.

Next, computer simulation was performed to estimate change in temperature of the cylinder liner with the elapse of time during insert with respect to a cylinder liner having surface roughness of 5 $\mu$m by way of shot blasting and a cylinder liner having a surface roughness of 0 $\mu$m without effecting shot blasting. Condition of analysis in this simulation were as follows:

Analysis condition

Temperature of metal mold: 200° C.

Casting temperature: 800° C.

Temperature of the cylinder liner: 400° C.

Figure 3:
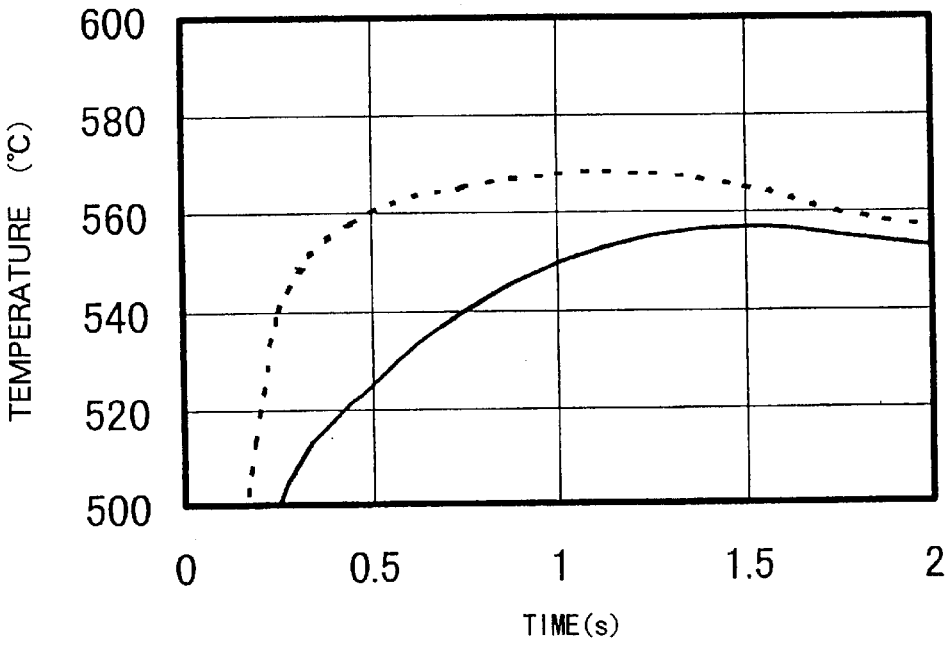
FIG. 3 is a graph showing conceivable temperature change of a cylinder liner subjected to outer peripheral surface roughening process and a cylinder liner not subjected to the roughening process.

Heat transmission coefficient between liner/block body: 0.2 cal/cm$^2$/° C./s for 5 $\mu$m roughness, and 0.4 cal/cm$^2$/° C./s for 0 $\mu$m roughness In a graph shown in FIG. 3, a solid line designates the cylinder liner having surface roughness of 0 $\mu$m, and a broken line designate the cylinder liner having surface roughness of 5 $\mu$m. As shown in the graph of FIG. 3, the temperature of the cylinder liner to which surface roughening is effected by shot blasting is immediately increased within a short period, whereas the temperature of the cylinder liner which is not subjected to surface roughening is gradually increased. Thus, it is understood that the heat transmission is effectively performed in case of the liner subjected to surface roughening process.

Figure 4:
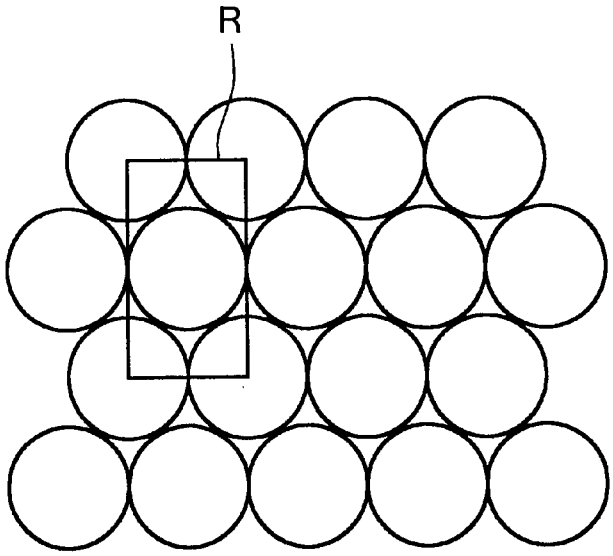
FIG. 4 is a plan view for description of one unit area including dimple area and non-dimpled area of the cylinder liner used for producing the cylinder block according to one embodiment of the present invention.

In view of the above, heat transmission coefficient becomes high by the increase in the surface area of the cylinder liner by effecting surface roughening with the shot blasting. Next, the relationship between a diameter of a shot ball used in the shot blast (hereinafter simply referred to as "shot diameter") and a surface area of the outer peripheral surface of the cylinder liner subjected to the surface roughening by the shot blast will be analyzed based on a geometrical model. The shot chip used in the method for producing the cylinder block according to the present invention is not a fragmental particle having acute angle, but a spherical particle. Further, the following geometrical model is based upon a premise in which mutually contacting recesses or dimples are formed on the surface of the cylinder liner as shown in FIG. 4 upon striking shot balls against the liner surface by shot blasting.

First, a total surface area S of the outer peripheral surface of the cylinder liner will be computed in case where the spherical shot balls sink into the surface by an amount of semi-sphere, that is, semi-spherical dimples are formed in the liner surface. The entire surface area S is computed through a sum of a dimpled unit area S1 and a non-dimpled unit area S2 other than the dimpled area and through numbers of the unit area, the numbers being obtained in consideration of a diameter "d" and height "h" of the cylinder liner. The dimpled unit area S1 is the total area of the dimples formed by plurality of shot balls, those dimples being surrounded by a rectangle R shown in FIG. 4. That is, the dimpled unit area S1 is the sum of the area of completely semi-spherical dimple formed by one shot ball and areas of parts of four dimples formed by four shot balls and surrounding the central semi-spherical dimple. On the other hand, the non-dimpled surface area S2 is the area surrounded by the rectangle R but the area other than the dimpled unit area S1 in FIG. 4. The dimpled unit area S1 is equal to the area of two semi-spherical dimples. Consequently, a sum of the dimpled unit area S1 and the non-dimpled unit area S2 is computed, and then, the total surface area of the cylinder liner can be computed by the sum and the diameter "d" and height "h" of the cylinder liner.

Assuming that the shot diameter is "D", the dimpled unit area S1 can be represented as follows:

$$S1 = 4\pi\left(\frac{D}{2}\right)^2 = \pi D^2$$

On the other hand, the non-dimpled unit area S2 can be represented as follows:

$$S2 = D \times \sqrt{3D} - \pi\left(\frac{D}{2}\right)^2 \times 2 = \frac{2\sqrt{3} - \pi}{2} D^2$$

Therefore, the total surface area of the cylinder liner is represented as follows where "d" and "h" represent a diameter and height of the cylinder liner, respectively.

$$S = (S1 + S2) \times \frac{\pi dh}{\sqrt{3}\, D^2} = \left(\pi D^2 + \frac{2\sqrt{3} - \pi}{2} D^2\right) \times \frac{\pi dh}{\sqrt{3}\, D^2} = \left(\frac{\pi}{2\sqrt{3}} + 1\right)\pi dh$$

Parameters contained in this equation do not contain the shot diameter "D", but only contains diameter "d" and height "h" of the cylinder liner. Accordingly, the total surface area S of the cylinder liner is not dependent on the shot diameter "D". In other words, the total surface area S of the cylinder liner can be constant if the diameter d and the height h of the cylinder liner are constant values regardless of the value of the shot diameter.

Figure 5:
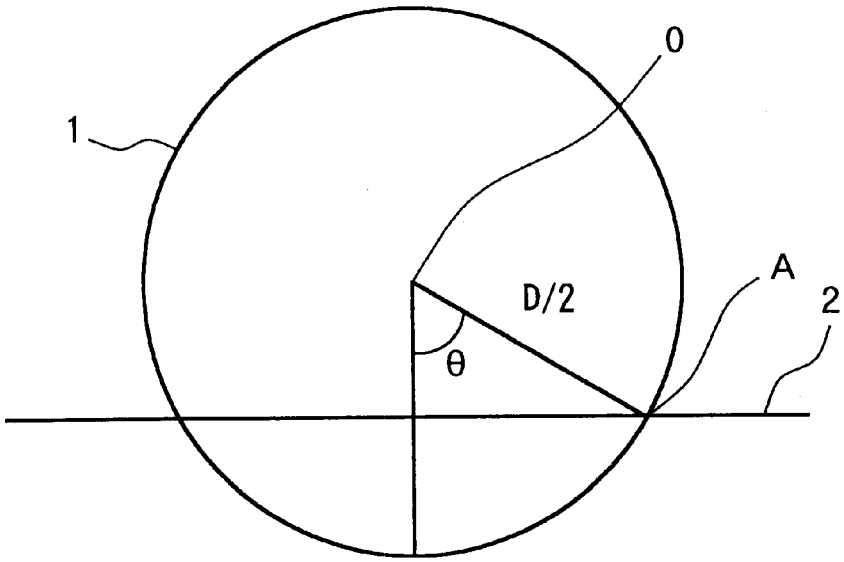
FIG. 5 is a cross-sectional view for description of a state where a shot ball is sunk into the cylinder liner by an amount shallower than a semi-spherical depth, the liner being used for producing the cylinder block according to one embodiment of the present invention.
Figure 6:
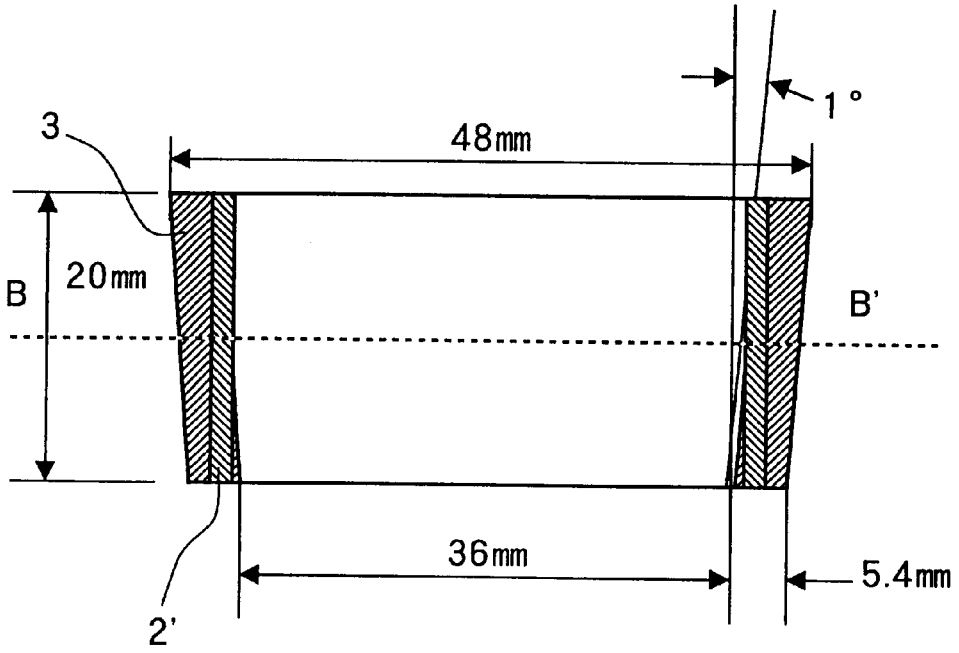
FIG. 6 is a cross-sectional view showing a casted product for evaluating the method for producing the cylinder block according to one embodiment of the present invention.

Next, will be analyzed the total surface area S' of the outer periphery of the cylinder liner in case where the shot balls cannot be sunk by an amount of semi-sphere due to weak shot. Such insufficient shot may occur due to the employment of Zn shot having low specific gravity or due to low gas pressure. Similar to the above computation where the spherical pieces are sunk by their semi-spherical amount, a sum of the dimpled unit area S1' and the non-dimpled unit area S2' is computed, and then, the total surface area of the outer periphery of the cylinder liner is computed using the parameters of a diameter "d" and height "h" of the cylinder liner. As shown in FIG. 5, provided that a radius of the shot ball is "D/2", and that the surface of the shot ball and the outer periphery of the cylinder liner intersect with each other at an intersecting point A, and that a vertical radius extending perpendicular to the surface of the cylinder liner and a slanted radius extending between the center of the shot ball and the intersecting point A define an angle "θ" in case where the shot ball partly sinks into the outer peripheral surface 2 of the cylinder liner. In this case, the dimpled unit area S1' can be represented as follows:

$$S1' = 2 \times 2\pi \int_{\frac{1}{2}D\cos\theta}^{\frac{1}{2}D} \sqrt{\frac{D^2}{4} - x^2}\, dx$$

Provided that $$x = \frac{D}{2}\cos\varphi$$

then

-continued $$dx = -\frac{D}{2}\sin\varphi d\varphi$$

Thus, the dimpled unit area S1' is computed as follows:

$$\begin{aligned} S1' &= 2 \times 2\pi \int_{\theta}^{0} \left(\frac{D}{2}\sin\varphi\right)\left(-\frac{D}{2}\sin\varphi\, d\varphi\right) \\ &= 2 \times \frac{\pi}{2} D^2 \int_0^{\theta} \sin^2\varphi\, d\varphi \\ &= 2 \times \frac{\pi}{2} D^2 \int_0^{\theta} (1 - \cos^2\varphi) d\varphi \\ &= 2 \times \frac{\pi}{2} D^2 \int_0^{\theta} \left(1 - \frac{\cos 2\varphi + 1}{2}\right) d\varphi \\ &= \frac{\pi}{2} D^2 \left(\theta - \frac{1}{2}\sin 2\theta\right) \end{aligned}$$

On the other hand, the non-dimpled unit area S2' can be represented as follows:

$$S2' = D\sin\theta \times \sqrt{3D}\sin\theta - \pi\left(\frac{D\sin\theta}{2}\right)^2 \times 2 = \left(\sqrt{3} - \frac{\pi}{2}\right) D^2 \sin^2\theta$$

Thus, the entire outer peripheral surface area S' of the cylinder liner is represented as follows where "d" and "h" are diameter and height of the cylinder liner:

$$S' = (S1' + S2') \times \frac{\pi dh}{\sqrt{3}\, D^2 \sin^2\theta} = \left\{\frac{\pi}{2} D^2 \left(\theta - \frac{1}{2}\sin 2\theta\right) + \left(\sqrt{3} - \frac{\pi}{2}\right) D^2 \sin^2\theta\right\} \times \frac{\pi dh}{\sqrt{3}\, D^2 \sin^2\theta} \therefore S' = \left(\frac{\pi\theta}{2\sqrt{3}\sin^2\theta} - \frac{\pi\cos\theta}{2\sqrt{3}\sin\theta} + \left(1 - \frac{\pi}{2\sqrt{3}}\right)\right)\pi dh$$

The parameters contained in this equation do not include the shot diameter D but only include the diameter "d" and the height "h". In other words, the entire outer peripheral surface area S' of the cylinder liner is not dependent on the shot diameter D in the case where sink amount of the shot ball does not reach the semi-sphere. Accordingly, the total surface area S' of the cylinder liner can be constant if the diameter d and the height h of the cylinder liner are constant values regardless of the value of the shot diameter.

Differentiation of the entire surface area S' with θ can be expressed as follows:

$$\frac{dS'}{d\theta} = \frac{\pi^2 dh}{\sqrt{3}}\left(\frac{1}{\sin^2\theta} - \frac{\theta\cos\theta}{\sin^3\theta}\right)$$

In this case, sinking amount of the shot ball is less than semi-sphere, and therefore, θ is in the range of $0<\theta<\pi/2$ as is apparent from FIG. 5. In this range of θ, because dS'/dθ provides a positive value, the total surface area S' is an increasing function. Accordingly, the maximum surface area S' is provided when the angle θ reaches π/2. This implies that the shot ball is sunk into the cylinder liner surface by the amount of semi-sphere.

In view of the above, it is understood that the maximum surface area is provided when the shot ball is sunk into the cylinder liner surface by the amount of semi-sphere. Incidentally, kinetic energy of the shot balls forms the dimples. The kinetic energy E is represented by the following equation where "m" represents a mass of the shot ball, and "v" represents a velocity of the shot ball:

$$E = \frac{1}{2}mv^2$$

With this equation, it is apparent that mass "m" and velocity "v" should be increased in order to sink the shot ball deeply into the outer peripheral surface of the cylinder liner by semi-spherical amount. Further, the smaller the diameter of the shot ball, the deeper the shot ball sinks taking the force from the cylinder liner to the ball into consideration during sinking. The shot ball having a smaller diameter with high specific gravity is preferable, because such shot ball can maintain its mass. Consequently, in the method for producing the cylinder block according to the present invention, the shot ball having high specific gravity is employed.

Incidentally, there may be a case in the shot blasting where the shot is excessively high so that the shot balls are sunk deeply into the liner by an amount more than semi-sphere. However, in the latter case, it is impossible to remove such shot balls out of the liner, and such liner is not available as a product. Therefore, such situation can be neglected.

The above-described analysis reveals that the entire outer peripheral surface area S or S' of the cylinder liner is not dependent on the shot diameter D. However, if the shot diameter D is too small, the molten metal cannot be entered into the deepest portion of the dimples due to surface tension of the molten metal. This results from the computer simulation in FIG. 2. Next, the relationship between the shot diameter and the surface tension of the molten metal will be investigated. The following formula is provided where "p" represents casting pressure, "D" represents shot diameter, and "γ" represent surface tension:

$$p \cdot \pi\left(\frac{D}{2}\right)^2 \geq \int_0^{\pi} \gamma \cdot D \quad d\theta$$

Upon modification of this formula, D must be:

$$\therefore D \geq \frac{4\gamma}{p}$$

In the depicted detailed embodiment described later, because γ=900 N/m and p=76 MPa, the shot diameter D must be not less than 48 μm.

Next, the detailed embodiment based on the above investigation in accordance with the present invention will be described. First, surface roughening is performed by shot blasting with respect to the inner peripheral surface of the cylinder liner formed of Al—Si—Cu hyper eutectoid Si alloy containing from 14 to 25 wt % of Si. Next, surface roughening is performed by shot blasting with respect to the outer peripheral surface of the cylinder liner to form semi-spherical dimples on the outer surface as a result of sinks of shot balls by their semi-spherical amount into the cylinder liner. In the latter shot blasting, are used shot balls made from Zn and having diameters of 0.4 mm or 0.8 mm, or stainless beads having diameters of 0.4 mm. Next, adiabatic particles made from BN (boron nitride) are adhered onto the inner peripheral surface of the cylinder liner. Finally, a metal mold (not shown) is brought into abutment with the inner peripheral surface of the cylinder liner to hold the cylinder liner to the metal mold. Then, the cylinder liner is preheated to the temperature of 300° C., and the molten metal is filled around the cylinder liner to provide melt-bonding connection between the cylinder liner and the block body. Thus, a cylinder block can be produced.

Surface roughening the inner peripheral surface of the cylinder liner causes heat insulation between the inner peripheral surface of the cylinder liner and the metal mold, thereby improving melt-bonding between the outer peripheral surface of the cylinder and the molten metal. Further, the semi-spherical dimples at the outer peripheral surface can provide maximum outer peripheral surface area of the cylinder liner, thereby promoting melt-bonding between the cylinder liner and the molten metal. Moreover, the adhesion of the adiabatic particles to the inner peripheral surface of the cylinder liner can improve heat insulation between the inner peripheral surface of the cylinder liner and the metal mold, thereby promoting melt-bonding between the outer peripheral surface of the cylinder liner and the molten metal.

Next, on the basis of the above analysis, casting tests were performed in order to investigate the effect attendant to the semi-spherical dimples at the outer peripheral surface of the cylinder liner by way of shot blasting. 90 tons cupping test was performed as the casting tests. Testing conditions were as follows:

Testing condition

Casting machine: Toshiba's 90t lateral cold chamber type

Shot weight/product weight: 140 g/42 g

Casting temperature: 680° C.

Casting pressure: 74.5 MPa

Injection speed: 0.8 m/s

Curing time: 5 s

The cylinder liner 2' used in the tests had generally cylindrical shape. The cylinder liner 2' was surrounded by the molten metal which was the material of the block body. Upon melt-bonding between the molten metal and the cylinder liner 2', was provided a generally cylindrical casted product including the cylinder liner 2' and the insert portion 3. As shot balls, used were Zn balls having diameters of 0.4 mm and 0.8 mm, stainless beads having diameters of 0.4 mm, and stainless cut wires having diameters of 0.4 mm to clarify the effect and to prove the above analysis on the shot blasting.

Figure 7:
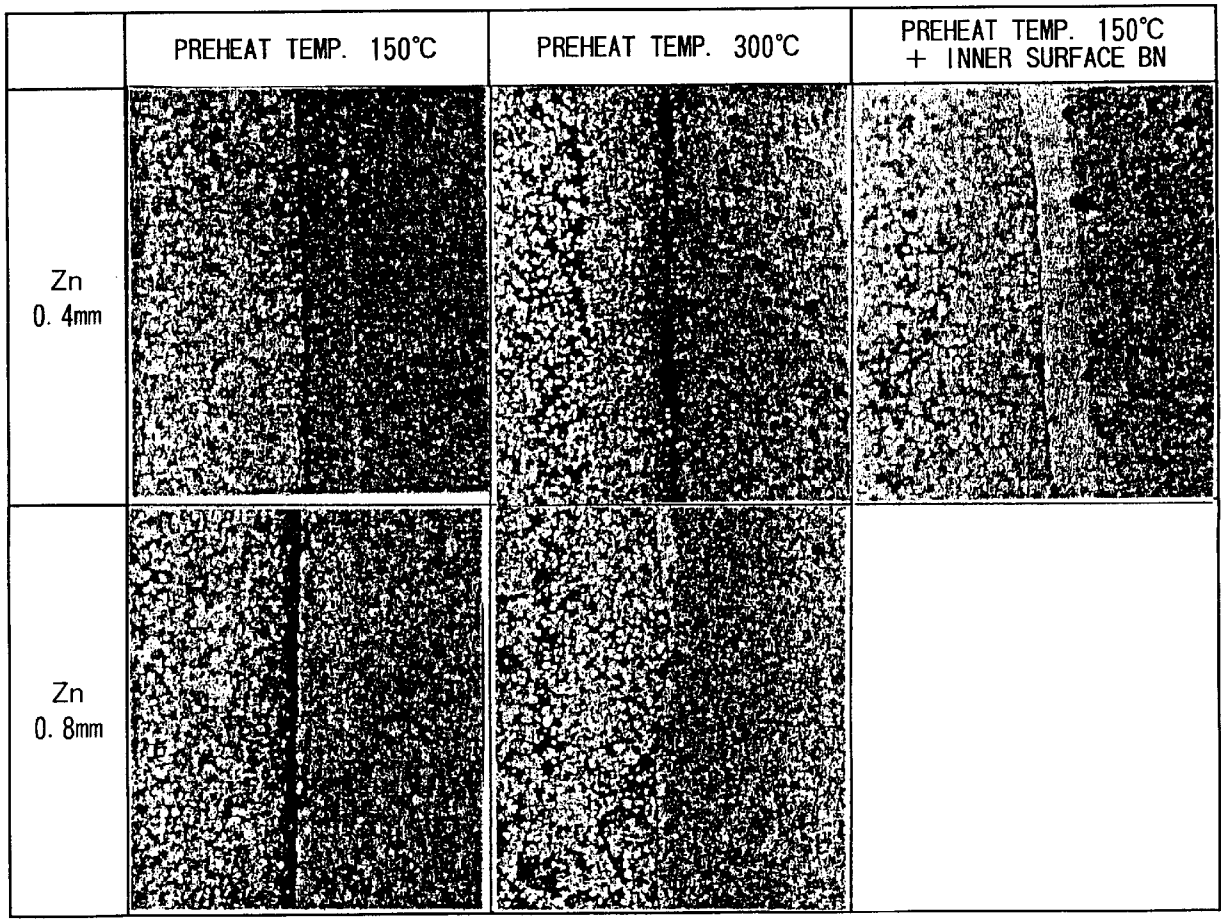
FIG. 7 is microscopic photographs of metallurgical construction showing the results of tests for evaluating the method for producing the cylinder block according to one embodiment of the present invention.
Figure 8:
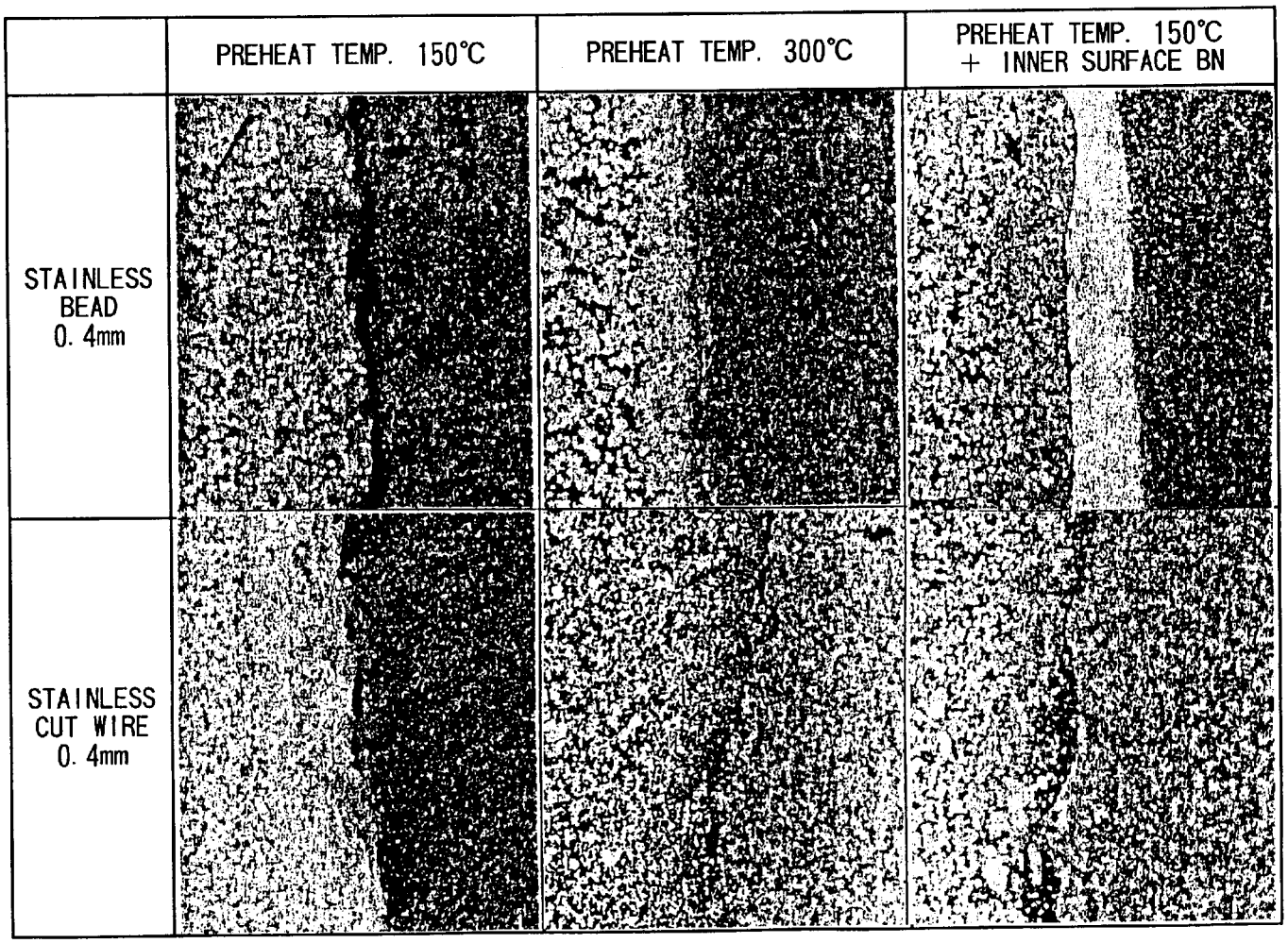
FIG. 8 is microscopic photographs of metallurgical construction showing the results of tests for evaluating the method for producing the cylinder block according to one embodiment of the present invention.

Shot velocity were the same regardless of the kind of the shot balls. Incidentally, even though stainless cut wires are outside of the above analysis since their shapes are not spherical, the test using the cut wires were conducted for the purpose of comparison. Further, the cylinder liner was preheated to about 150° C. and 300° C. prior to filling of the molten metal into the metal mold. Furthermore, shot blasting was performed to the inner peripheral surface of the cylinder liner for providing adiabatic relation between the cylinder liner and the metal mold. Test results are shown in Table 1 below and FIGS. 7 and 8.

TABLE 1

| Material of shot particle (diameter) | Preheat Temp. 150° C. Color check | Preheat Temp. 150° C. Optical microscope | Preheat Temp. 300° C. Color check | Preheat Temp. 300° C. Optical microscope | Preheat temp 150° C. BN adhesion to inner surface of liner Color check | Preheat temp 150° C. BN adhesion to inner surface of liner Optical microscope |
|---|---|---|---|---|---|---|
| Zn 0.4 mm | A | C | B | B | B | C |
| Zn 0.8 mm | A | C | B | B | — | — |

TABLE 1-continued

| Material of shot particle (diameter) | Preheat Temp. 150° C. Color check | Preheat Temp. 150° C. Optical microscope | Preheat Temp. 300° C. Color check | Preheat Temp. 300° C. Optical microscope | Preheat temp 150° C. BN adhesion to inner surface of liner Color check | Preheat temp 150° C. BN adhesion to inner surface of liner Optical microscope |
|---|---|---|---|---|---|---|
| Stainless bead 0.4 mm | A | A | A | A | A | A |
| Stainless cut wire 0.4 mm | A | B | A | A | A | A |

A: not less than 80% of bonding degree
B: from 50 to 80% of bonding degree
C: not more than 50% of bonding degree Color check referred in the Table will be described. A casted cylinder block as a test piece was cut at a proper axial position, and ink was sprayed and developing agent was coated onto the cut surface. After elapse of a predetermined period, the ink sprayed at the cut surface was oozed out at an end face of the casted cylinder block. The smaller amount of oozed sprayed ink should result if the bonding degree between the cylinder liner and the molten metal is sufficient. Further, the optical microscope referred in the Table implies the clearness of the boundary between the cylinder liner and the molten metal in the optical microscopic photograph in order to determine the melt bonding degree therebetween. Unclearness of the boundary implies sufficient melt bonding. Test results of the color check and optical microscope are classified into A, B and C ranks where A represents not less than 80% of bonding degree, B represents from 50 to 80% of bonding degree and C. represents not more than 50% of bonding degree.

If shot blast was performed with the Zn shot ball, the same results were obtained regardless of the diameters of the Zn balls, because the entire outer peripheral areas of the cylinders liner were constant irrespective of the diameter of the shot balls. Stated more accurately, test results were different from each other due to the difference in the weight per shot ball under the same shot speed. However, the difference were within each evaluation range A, B and C.

In comparison of the Zn shot balls with the stainless beads each having diameter of 0.4 mm, test results attendant to the stainless beads were superior to that attendant to the Zn shot balls, wherein the specific gravity of the stainless bead is higher than that of the Zn ball and diameter of the bead is equal to the diameter of the Zn ball. In comparison of the stainless cut wire having a diameter of 0.4 mm with the stainless bead having a diameter of 0.4 mm, similar test results were obtained. However, in the depicted embodiment, the test result obtained by sinking the spherical shot balls into the outer peripheral surface of the cylinder liner by a semi-spherical amount was the same as that provided by using the acute angled shot particles.

Next, test results attendant to the preheating temperature to the cylinder liner of 150° C. and 300° C. in case of the employment of various shot balls will be described. Generally, superior test results were obtained in case of the preheating temperature of 300° C. However this test result was approximately the same as the test result attendant to the employment of the BN particles adhered to the inner peripheral surface of the cylinder liner with the preheating temperature of 150° C. because sufficient heat insulation between the cylinder liner and the metal mold was provided by the BN particles.

Further, comparative tests were conducted with the above testing condition between a case where the cylinder liner was subjected to inner peripheral surface roughening and a case where the cylinder liner was not subjected to the roughening. In the latter case, the testing condition was the same as that where the stainless beads having diameter of 0.4 mm were used.

Figure 9:
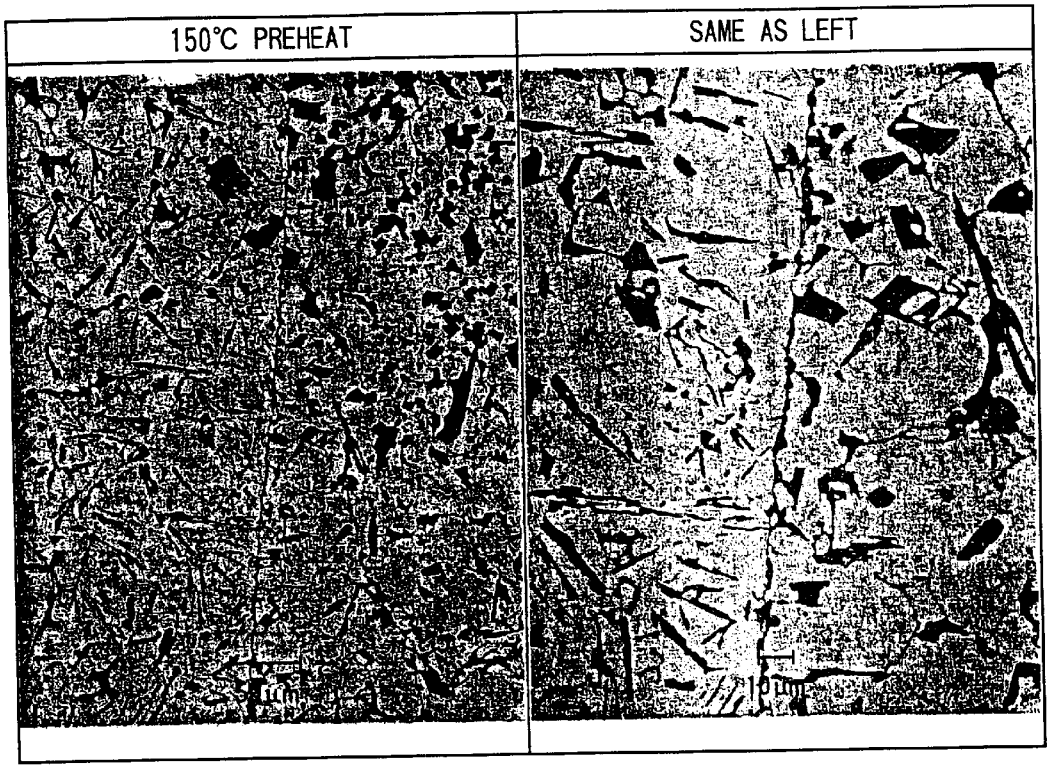
FIG. 9 is microscopic photographs of metallurgical construction showing the results of tests for evaluating the method for producing the cylinder block in which inner peripheral surface roughening process is not performed, and wherein the right side photo is the enlargement of the left side photo with 2.5 times magnification.

In the optical microscopic photographs of FIG. 9 showing the boundary line at the melt bonding portion in a case where the inner peripheral surface roughening was not performed, a linear boundary line is clear. This implies insufficient melt bonding. On the other hand, according to FIG. 9 which shows the test result attendant to the inner peripheral surface roughening treatment employing the stainless beads having diameter of 0.4 mm, melt bonding portion is not linear. This implies that sufficient melt bonding results if the inner peripheral surface roughening is performed.

The method for producing the cylinder block according to the present invention is not limited to the above described embodiment, but various modifications and improvements may be made within the scope of claims. For example, instead of Zn shot balls having diameters of 0.4 mm or 0.8 mm, or the stainless beads having diameter of 0.4 mm, any shot piece having random shape and other than spherical shape is available such as the above described stainless cut wires having diameter of 0.4 mm.

Further, in the depicted embodiment, adiabatic particle adhesion process is performed after the inner peripheral surface roughening process and prior to the melt bonding process. However, the adiabatic particles can be adhered to the inner peripheral surface not subjected to surface roughening. In the latter case, the adiabatic particle adhesion process can be performed prior to the melt bonding process.

Further, instead of BN particles as adiabatic particles, other particles such as talc and kaolin are available.

Further, in the above described embodiment, four processes including inner peripheral surface roughening process, outer peripheral surface roughening process, adiabatic particle adhesion process and melt bonding process are performed. However, any one or two of inner peripheral surface roughening process, outer peripheral surface roughening process and adiabatic particle adhesion process can be combined with the melt bonding process.

Further, in the above-described embodiment, adiabatic particle adhesion process is performed. However, instead of this process, a highly lubricant material such as molybdenum disulfide can be adhered to the inner peripheral surface of the cylinder liner. In the latter case, a casted cylinder block can be easily removed out of the metal mold after melt-bonding process.

What is claimed is:

1. A method for producing a cylinder block including the steps of:

roughening by shot blasting an outer peripheral surface of a cylinder liner formed of aluminum alloy; and melt-bonding a molten metal to the outer peripheral surface of the cylinder liner by filling the molten metal around the outer peripheral surface of the cylinder liner, while the cylinder liner is held to a metal mold by abutting the metal mold to an inner peripheral surface of the cylinder liner; and the improvement comprising the steps of:

roughening the inner peripheral surface of the cylinder liner by shot blasting prior to the melt-bonding step.

2. The method for producing the cylinder block as claimed in claim 1, wherein the shot-blasting for roughening the outer peripheral surface comprises the step of forming semi-spherical recesses at the outer peripheral surface by striking at least one shot ball onto the outer peripheral surface.

3. The method for producing the cylinder block as claimed in claim 1, further comprising the step of adhering adiabatic powders onto the inner peripheral surface of the cylinder liner after roughening the inner peripheral surface and prior to the melt-bonding step.

* * * * *